US006375019B1

(12) United States Patent
Hirota et al.

(10) Patent No.: US 6,375,019 B1
(45) Date of Patent: Apr. 23, 2002

(54) STRAW WITH PLUG

(75) Inventors: Kashichi Hirota, Hachioji; Makoto Kaneda, Hiki-Gun, both of (JP)

(73) Assignee: Kyowa Electric and Chemical Co., Ltd., Tokyo (JP)

( * ) Notice: Subject to any disclaimer, the term of this patent is extended or adjusted under 35 U.S.C. 154(b) by 0 days.

(21) Appl. No.: 09/761,723

(22) Filed: Jan. 18, 2001

(30) Foreign Application Priority Data

Sep. 13, 2000 (JP) ..... 12-278145

(51) Int. Cl.[7] ..... B65D 39/00
(52) U.S. Cl. ..... 215/229; 220/705; 239/33
(58) Field of Search ..... 215/229; D9/305, D9/337, 338; 220/705, 707, 708, 709; 229/103.1; 239/33

(56) References Cited

U.S. PATENT DOCUMENTS 2,066,121 A * 12/1936 Morris ..... 215/73
3,291,331 A * 12/1966 Grisham et al. ..... 215/1
3,776,458 A * 12/1973 Chunga, Sr. ..... 239/24
5,339,982 A * 8/1994 Tardie ..... 220/708
5,823,422 A * 10/1998 Collier et al. ..... 229/103.1
6,050,444 A * 4/2000 Sugg ..... 220/707
6,116,446 A * 9/2000 Haughton et al. ..... 215/355

* cited by examiner

*Primary Examiner*—Lee Young
*Assistant Examiner*—Lien Ngo
(74) *Attorney, Agent, or Firm*—Jacobson Holman, PLLC

(57) ABSTRACT

A straw including a straw member having an outer straw portion and an inner straw portion, the outer and inner straw portions being telescopingly fitted with each other, the inner straw portion including an elastic upper section, and a cylindrical plug member having an opening at the upper end thereof. The inner straw portion is retained in the state inserted into a beverage container by mounting the plug member to the upper end of a mouth of the beverage container, and the upper section of the inner straw portion is bent by pressing with a beverage container cap so as to attach the beverage container cap to the beverage container, and the upper end of the inner straw portion is protruded from the upper end of the plug member by detaching the beverage container cap.

20 Claims, 6 Drawing Sheets

STRAW WITH PLUG

FIELD OF THE INVENTION

The present invention relates to a straw, more particularly to a straw capable of being contained and stored within a capped beverage container.

BACKGROUND OF THE INVENTION

In a beverage container or dispenser capable of being capped, when the beverage container is to be capped with leaving a certain amount of beverage therein, a straw which has been in use thus far is usually taken out of the beverage container. This is done because the beverage container cannot be capped due to the interference with the straw, and even if the beverage container could successfully be capped, the straw could fall down in the container and could be sunk in the remaining beverage so that it would become unable for the straw to be taken out of the beverage container or the straw could be wetted by the beverage throughout its length so that user's hands would be made smeary when the straw would be taken out of the container. The straw which has been taken out of the beverage container will generally be thrown aside and will never be reused. This is because the straw which has once been used and taken out of the beverage container is inevitably wetted with the beverage, and an insanitary condition and surrounding contamination is caused by storing as it. It is troublesome to rinse and store the used straw separately from the beverage containers each time the straws are taken out of the beverage containers.

SUMMARY OF THE INVENTION

In view of the foregoing disadvantages inherent in conventional beverage containers, it is an object of the present invention to provide a straw capable of being contained and stored within a capped beverage container, sanitarily and readily, without any disadvantages, such as the inability of taking out the straw from the beverage container or the possibilities of causing surrounding contamination.

According to a first aspect of the present invention, there is provided a straw comprising a straw member having an outer straw portion and an inner straw portion, the outer and inner straw portions being telescopingly fitted with each other, the inner straw portion including a bendable or retractable upper section, and a cylindrical plug member having an opening at the upper end thereof, wherein the upper end of the outer straw portion is formed integrally with or fixed to the plug member, the inner straw portion vertically extending through the plug member with restricted downward movement of the inner straw portion, wherein the inner straw portion is retained in the state inserted into a beverage container by mounting the plug member to the upper end of a mouth of the beverage container, the upper section of the inner straw portion being bent or axially retracted to store it in the plug member by pressing the upper end of the inner straw portion protruding from the upper end of the plug member with a beverage container cap so as to attach the beverage container cap to the beverage container, and the upper end of the inner straw portion being protruded from the upper end of the plug member by releasing the bending or retracted state of the upper section of the inner straw portion by detaching the beverage container cap.

In one mode of embodiment according a first aspect of the present invention, the upper section of the inner straw portion may be formed of at least one component selected from the group consisting of silicon elastomer, polyurethane elastomer, polyester elastomer, polyamide elastomer, and polyolefin elastomer.

In another mode of embodiment according a first aspect of the present invention, the upper end of the inner straw portion may be protruded in the range of about 10 to 15 mm from the mouth of the plug member when the inner straw portion is located at the lowest position thereof.

In still another mode of embodiment according a first aspect of the present invention, the plug member may include a flanged portion protruding outward along the upper rim of the plug member, wherein the plug member is mounted to the mouth of the beverage container with placing the flanged portion on the upper end of the mouth of the beverage container.

In yet another mode of embodiment according a first aspect of the present invention, the outer straw portion may be longitudinally retractable. For example, the outer straw portion may comprise an accordion portion retractable or extensible in the longitudinal direction. Otherwise, the outer straw portion may comprise an upper outer straw portion and a lower outer straw portion, wherein the upper outer and lower straw portions are telescopingly fitted with each other, and the upper end of the upper outer straw portion is integrally formed with or fixed to the plug member.

In a further mode of embodiment according a first aspect of the present invention, the plug member may include a vent hole at the sidewall or bottom section of the plug member.

In still a further mode of embodiment according to a first aspect of the present invention, the inner straw portion may include a bendable accordion bending portion.

According to a second aspect of the present invention, there is provided a beverage container with straw to which the aforementioned straw is mounted.

According to a third aspect of the present invention, there is provided a combination of straw and beverage container cap, comprising a straw including a straw member having an outer straw portion and an inner straw portion which are telescopingly fitted with each other, and a cylindrical plug member having an opening at the upper end thereof, wherein the upper end of the outer straw portion is formed integrally with or fixed to the plug member, the inner straw portion vertically extending through the plug member with restricted downward movement of the inner straw portion, wherein the inner straw portion is retained in the state inserted into a beverage container by mounting the plug member to the upper end of a mouth of the beverage container, and a beverage container cap including an upper section formed with a straw storing portion and a sidewall portion to be fitted to the mouth of the beverage container, wherein the upper end of the inner straw portion protruding from the upper end of the plug member mounted to the mouth of the beverage container is stored within the straw storing portion so as to attach the beverage container cap to the beverage container.

In one mode of embodiment according a third aspect of the present invention, the plug member may include a flanged portion protruding outwardly along the upper rim of the plug member, wherein the plug member is attached to the mouth of the beverage container with placing the flanged portion on the upper end of the mouth of the beverage container.

In another mode of embodiment according a third aspect of the present invention, the outer straw portion may be longitudinally retractable. For example, the outer straw portion may comprise an accordion portion retractable or extensible in the longitudinal direction. Otherwise, the outer straw portion may comprise an upper outer straw portion and a lower outer straw portion, wherein the upper outer and lower straw portions are telescopingly fitted with each other, and the upper end of the upper outer straw portion is integrally formed with or fixed to the plug member.

In still another mode of embodiment according a third aspect of the present invention, the plug member may include a vent hole at the sidewall or bottom section of the plug member.

In yet another mode of embodiment according a third aspect of the present invention, the inner straw portion may include a bendable accordion bending portion.

According to a fourth aspect of the present invention, there is provided a beverage container with straw, to which the aforementioned combination of straw and beverage container cap is mounted.

According to a fifth aspect of the present invention, there is provided a straw used in the aforementioned combination of straw and beverage container cap.

According to a sixth aspect of the present invention, there is provided a beverage container cap used in the aforementioned combination of straw and a beverage container cap.

DETAILED DESCRIPTION OF THE PREFERRED EMBODIMENTS

Preferred embodiments of the present invention will now be described with reference to the drawings.

Figure 1:
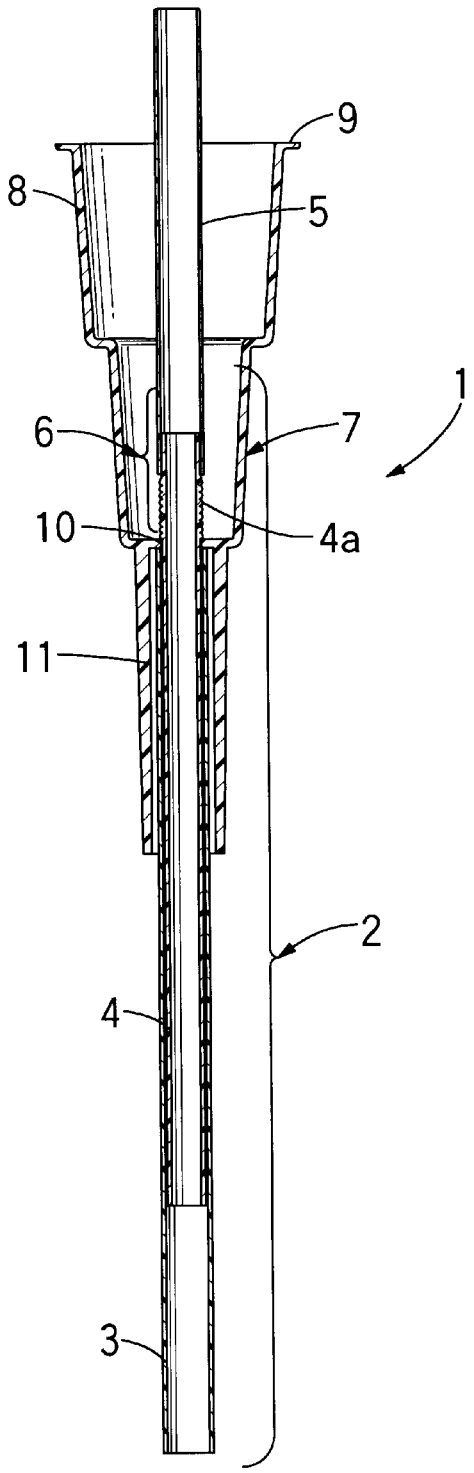
FIG. 1 shows a first embodiment of a straw according to the resent invention.

FIG. 1 is a view showing a first embodiment of a straw according to the present invention. As shown in FIG. 1, a straw 1 of the present invention comprises a straw member 2 and a plug member 7.

The straw member 2 includes an outer straw portion 3, a mid-straw portion 4 having a bendable accordion bending portion 4*a*, and an elastic upper straw portion 5. The upper end of the mid-straw portion 4 positioned higher than the accordion bending portion 4*a* is fittedly inserted into and fixed to the lower end of the upper straw portion 5, so that the mid-straw portion 4 and the upper straw portion 5 are integrated with each other to form an inner straw portion 6 having elasticity on its upper section. The outer straw portion 3 and the mid-straw portion 4 are formed of polypropylene, while the upper straw portion 5 is formed of silicon elastomer having elasticity.

The plug member 7 comprises a cylindrical plug portion 8 having an opening at the top thereof, a flanged portion 9 protruding outward along the upper rim of the plug portion 8, and an outer straw inserting portion 11 protruding downward from the bottom section of the plug portion 8. A straw through hole 10 is formed at the bottom section of the plug portion 8, and a space formed interior of the plug 8 communicates with a space formed interior of the outer straw insertion portion 11 via the straw through hole 10. The plug member 7 is formed of polypropylene or polyethylene.

The outer straw portion 3 is inserted into and fitted with the outer straw insertion portion 11 of the plug member 7, and the upper end of the outer straw portion 3 is fixed to the plug portion 8. The inner straw portion 6 extends vertically through the plug portion 8 and the lower section of the inner straw portion 6 is inserted into and fitted with the outer straw portion 3. The inner straw portion 6 can slidably be moved in the vertical direction. Thus, the outer straw portion 3 and the inner straw portion 6 are telescopingly fitted with each other, and serve in one united body as a straw which is longitudinally retractable or extensible.

Since the accordion bending portion 4*a* is positioned higher than the straw through hole 10, and the maximum outside diameter of the accordion bending portion 4*a* is defined larger than the diameter of the straw through hole 10, the accordion bending portion 4*a* cannot pass downwardly through the straw through hole 10. Thus, while the inner straw portion 6 is vertically slidable as described above, its downward movement is restricted. As shown in FIG. 1, when the lower end of the accordion bending portion 4*a* is placed at the bottom section of the plug portion 8, the inner straw portion 6 is located at its lowest position. Thus, when the inner straw portion 6 is located at this lowest position, the upper end of the inner straw portion 6 protrudes from the upper end of the plug member 7 by about 10 to 15 mm, while the lower end of the upper straw portion 5 corresponding to the upper section of the inner straw portion 6, and the upper end of the mid-straw portion 4 corresponding to the lower section of the inner straw portion 6 are positioned inside the plug member 7.

Figure 2:
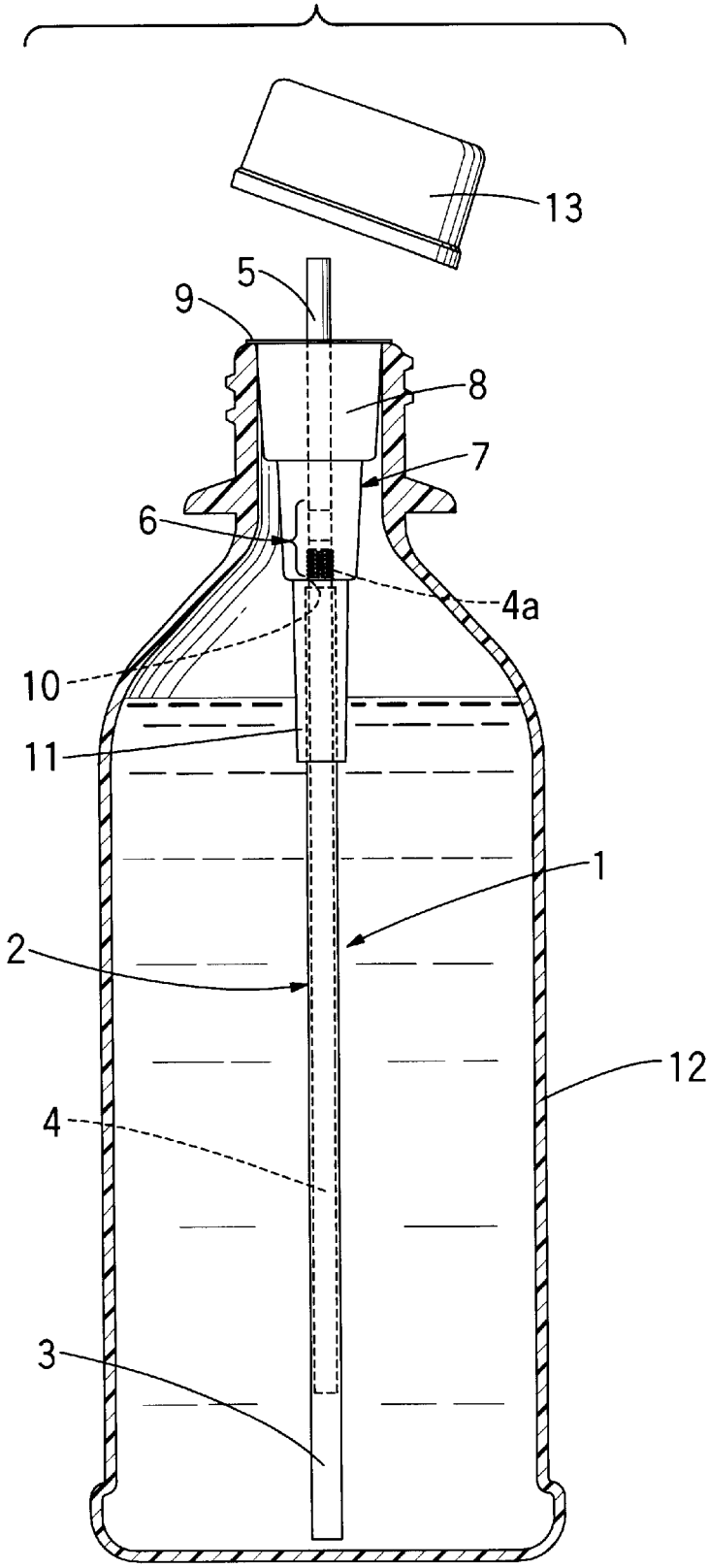
FIG. 2 shows a state where the straw shown in FIG. 1 is attached to a beverage container.

FIG. 2 shows the state where the straw of FIG. 1 is attached to the beverage container. As shown in FIG. 2, the plug member 7 is mounted to the upper end of the mouth of the beverage container 12 with placing the flanged portion 9 on the upper end of the mouth of the beverage container 12. By mounting the plug member 7 in this manner, the straw 1 is retained in the state inserted into the beverage container 12. The lower end of the outer straw portion 3 reaches the vicinity of the bottom wall of the beverage container 12. The inner straw portion 6 is located at its lowest position, and the upper end of the inner straw portion 6 protrudes from the upper end of the plug member 7 by about 10 to 15 mm.

Figure 3:
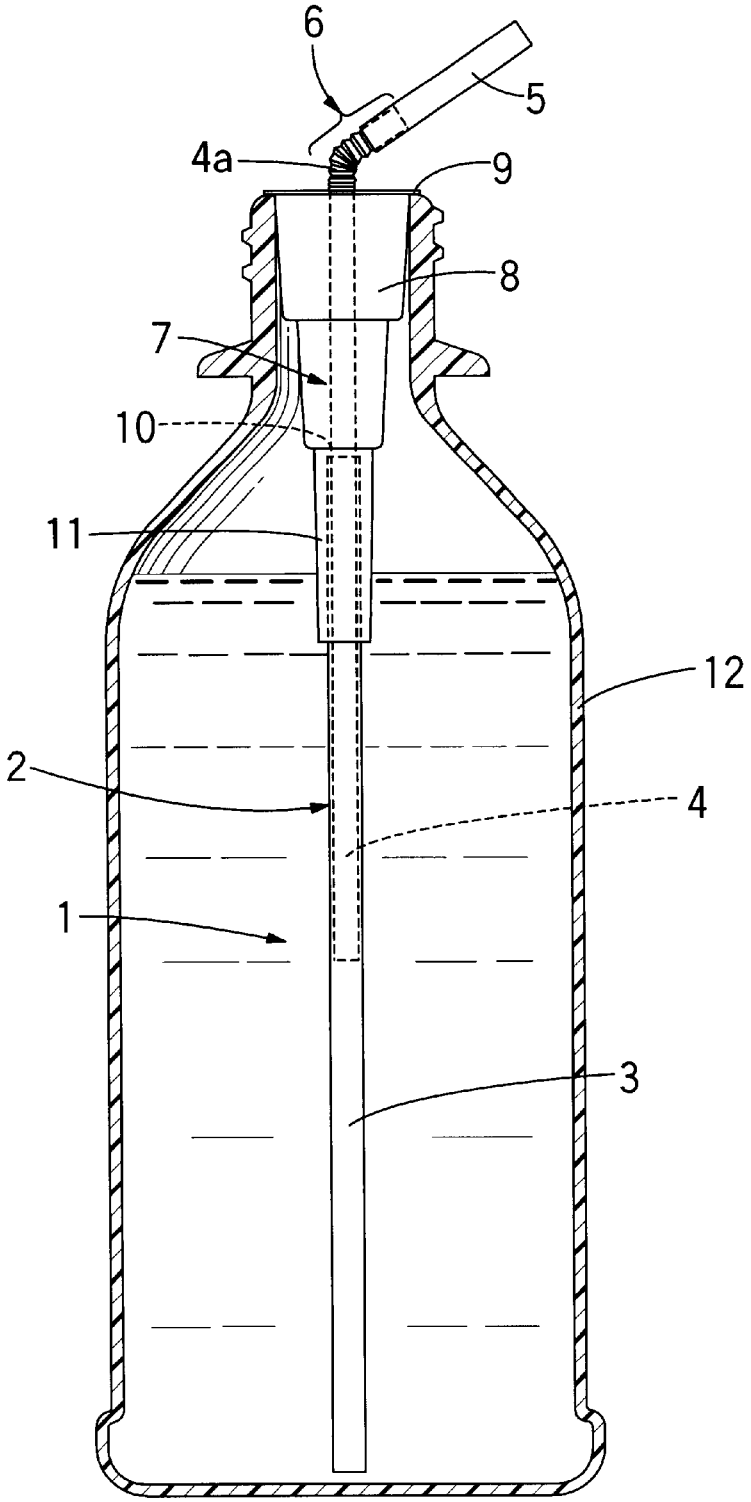
FIG. 3 shows a state where the straw shown in FIG. 1 is attached to the beverage container and an inner straw portion is pulled out.

FIG. 3 shows the state where the straw of FIG. 1 is attached to the beverage container and the inner straw portion is pulled out. When the beverage in the beverage container 12 is to be drunk with the straw 1, the inner straw portion 6 is pulled out upward and the accordion bending portion 4*a* is freely bent to be easily drunk. As shown in FIG. 2, the upper end of the inner straw portion 6 protrudes from the upper end of the plug member 7 by about 10 to 15 mm, so that the inner straw portion 6 may be easily pulled out by picking up the protruded portion of the inner straw portion 6. Since the lower end of the outer straw portion 3 extends to the vicinity of the bottom wall of the beverage container 12, a user may exhaustively drink the beverage in the beverage container 12.

Figure 4:
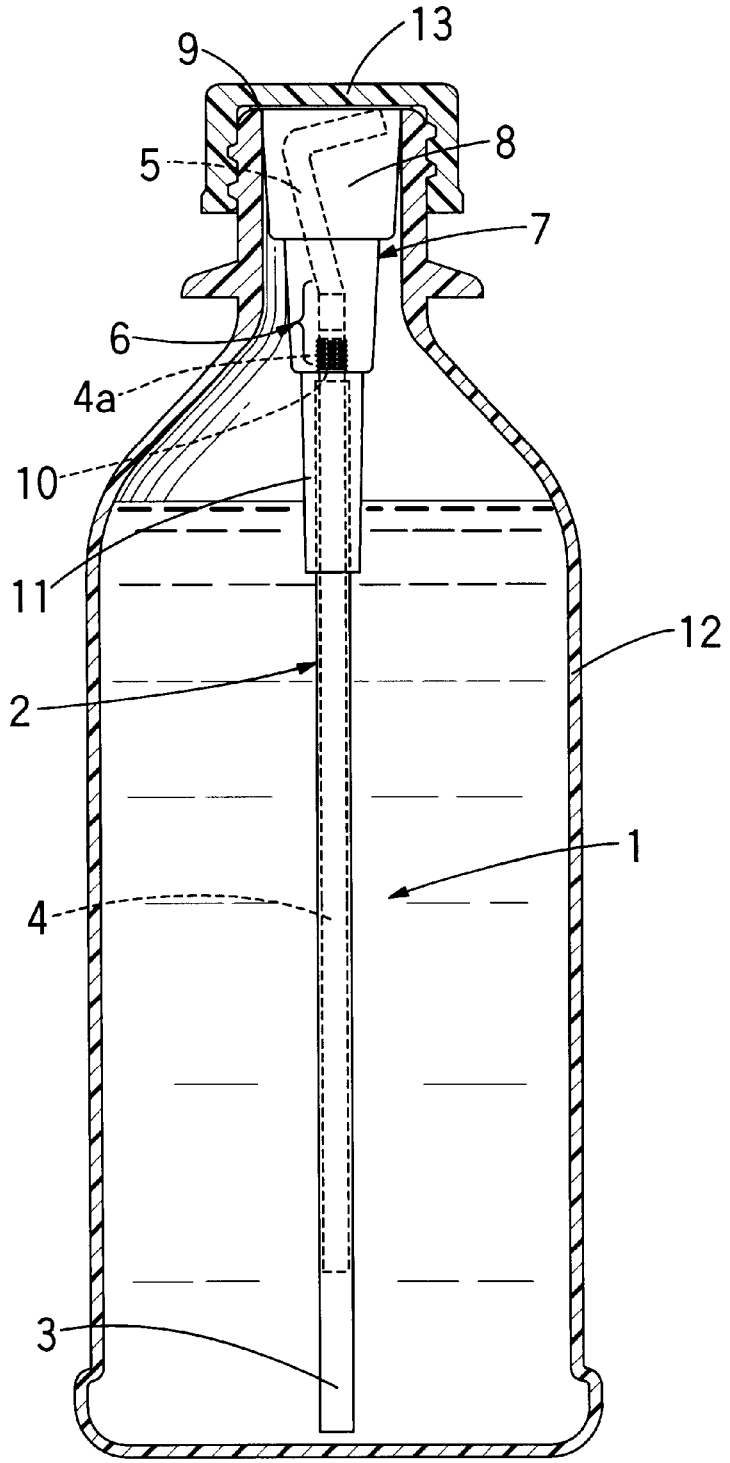
FIG. 4 shows a state where the straw shown in FIG. 1 and a beverage container cap are attached to the beverage container.

FIG. 4 shows the state where the straw and a cap of the beverage container of FIG. 1 are attached to the beverage container. When the straw 1 is to be stored, the inner straw portion 6 is inserted downwardly to the lowest position as shown in FIG. 2, and then the cap 13 is attached to the mouth of the beverage container 12 to store the straw in the beverage container 12. While the upper end of the inner straw portion 6 protrudes from the upper end of the plug member 7 by about 10 to 15 mm at the lowest position, the upper section of the inner straw portion 6 may be stored in the plug member 8 by pressing and bending the upper end of the inner straw portion 6 with the cap 13 and then attaching the cap 13 to the mouth of the beverage container 12 as shown in FIG. 4, because the upper section of the inner straw portion 6 including the protruded portion is formed of the upper straw portion 5 having elasticity. In this case, the flanged portion 9 placed on the mouth of the beverage container 12 is sandwiched between the upper end of the mouth of the beverage container 12 and a marginal portion of a top plate of the cap 13, and the cap 13 cannot thereby be completely fitted to the mouth of the beverage container 12. However, the flanged portion 9 serves as a seal member so that the beverage in the beverage container 12 will not leak outside.

Thus, when the straw 1 is stored within the beverage container 12 to which the cap 13 is attached, the plug member 7 allows the straw member 2 to be retained so as not to tile or submerge in the beverage, and also allows the upper section of the straw member 2 to be protected so as not to be wetted with the beverage. In addition, the flanged portion 9 prevents the drink in the beverage container 12 from leaking outside.

When the beverage in the beverage container 12 is to be drunk, the cap 13 of the beverage 12 is detached out and the inner straw portion 6 is pulled out upward. When the cap 13 of the beverage container 12 is detached, the elasticity of the upper section of the inner straw portion 6 allows the bending of the upper section of the inner straw portion 6 to be released so as to make the upper end of the inner straw portion 6 protrude from the upper end of the plug member 7 as shown in FIG. 2. Thus, the inner straw portion 6 is easily pulled out upward to drink the beverage by picking up the protruded portion of the inner straw portion 6. Restricting the downward movement of the inner straw portion 6 as described above can prevent the upper end of the inner straw portion 6 from being pushed downward and stored in the plug portion 8 without its bending by the pressure of the cap when the straw 1 is stored within the beverage container 12, and being not to protrude from the upper end of the plug member 7 when the cap 13 is detached.

Another embodiment according to the present invention will be described.

Figure 5:
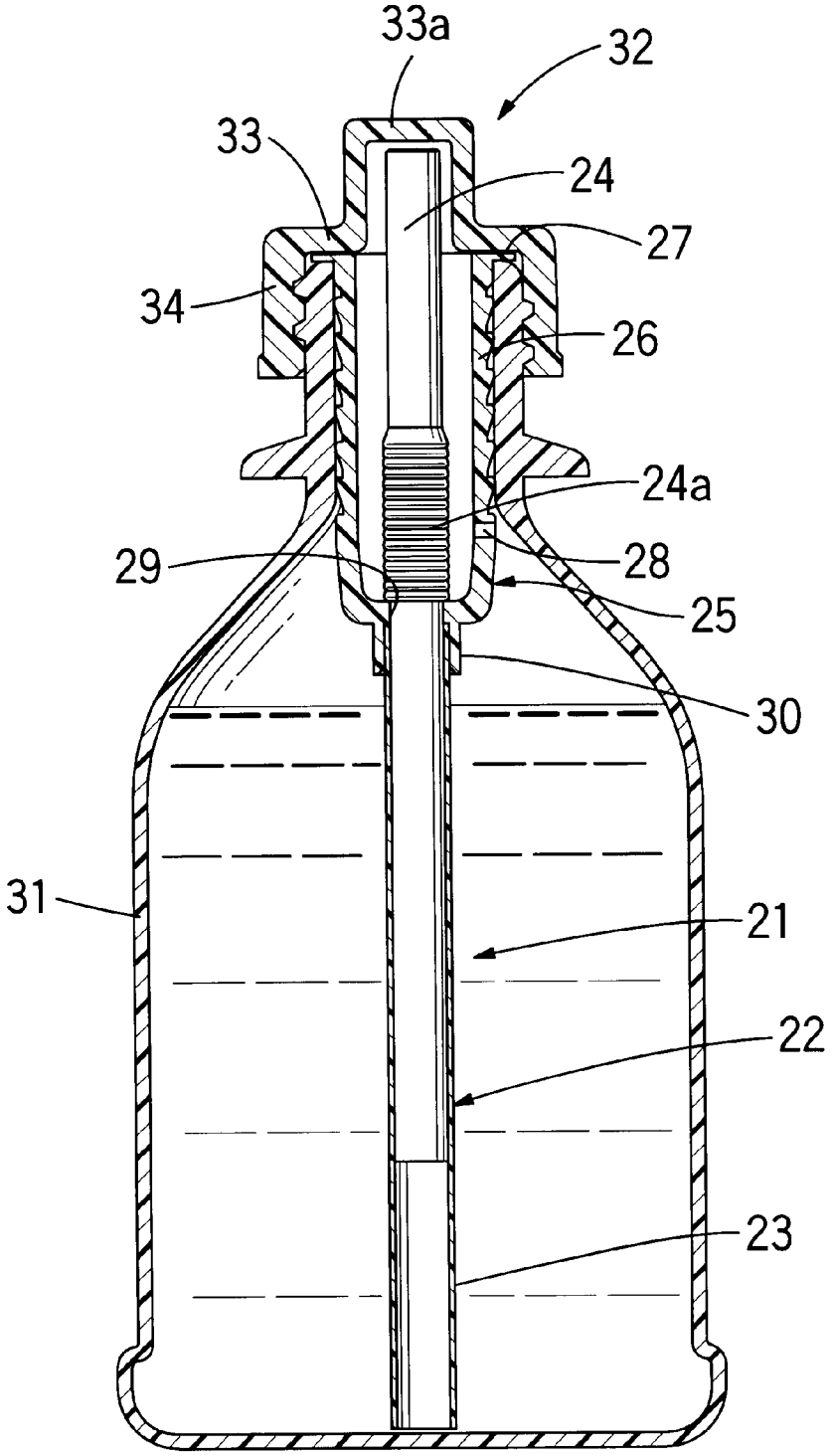
FIG. 5 shows a state where a straw according to a second embodiment of the present invention is stored within the beverage container to which a cap according to the second embodiment of the present invention is attached.

FIG. 5 shows the state where a straw and cap of a second embodiment are attached to the beverage container. As shown in FIG. 5, the straw 21 of this embodiment comprises a straw member 22 and a plug member 25. The straw member 22 includes an outer straw portion 23 and an inner straw portion 24 having an accordion bending portion 24*a* which is bendable or flexible. The outer straw portion 23 and the inner straw portion 24 are formed of polypropylene.

The plug member 25 includes a cylindrical plug portion 26 having an opening at the upper end thereof, a flanged portion 27 protruding outward along the upper rim of the plug portion 26, and a tubular outer straw inserting portion 30 protruding downward from the bottom of the plug portion 26. An air vent 28 is provided in the sidewall of the plug member 26 and a straw through hole 29 is formed at the bottom section of the plug portion 26. A space formed in the interior of the plug portion 26 communicates with a space formed in the interior of the outer straw inserting portion 30 via the straw through hole 29. This plug member 25 is formed of polypropylene or polyethylene.

The outer straw inserting portion 30 of the plug member 25 is inserted into and fitted with the outer straw portion 23, and the upper end of the outer straw portion 23 is fixed to the plug portion 26. The inner straw portion 24 extends vertically in the plug portion 26, and the lower section of the inner straw portion 24 is inserted into and fitted with the outer straw portion 23. The inner straw portion 24 can be slidably moved in the vertical direction. Thus, the outer straw portion 23 and the inner straw portion 24 are telescopingly fitted with each other, and serve as a straw longitudinally retractable or extensible in one united body.

The accordion bending portion 24*a* is positioned higher than the straw through hole 29 and the maximum outside diameter of the accordion bending portion 24*a* is defined larger than the diameter of the straw through hole 29. Thus, the accordion bending portion 24*a* cannot pass downwardly through the straw through hole 29. As mentioned above, while the inner straw portion 24 is vertically slidable, its downward movement is restricted. As shown in FIG. 5, when the lower end of the accordion bending portion 24*a* is positioned at the bottom section of the plug portion 27, the inner straw portion 24 is located at its lowest position. Thus, when the inner straw portion 24 is located at the lowest position, the upper end of the inner straw portion 24 protrudes from the upper end of the plug member 25.

The plug member 25 is attached to the upper end of the mouth of the beverage container 31 with placing the flanged portion 27 on the upper end of the mouth of the beverage container 31. By mounting the plug member 25 in this manner, the straw 21 is retained the state inserted into the beverage container 31 The lower end of the outer straw portion 23 reaches the vicinity of the bottom wall of the beverage container 31.

On the other hand, the cap 32 of the beverage container 31 includes a top plate 33 and sidewall portion 34 that is fitted with the mouth of the beverage container. The central portion of the top plate 33 protrudes outward to form a hollow straw storing portion 33*a*. A space formed inside the straw storing portion 33*a* is connected with a space formed inside the sidewall 34.

The cap 32 of the beverage container is attached to the mouth of the beverage container 31 with storing the upper end of the inner straw portion 24, which protrudes from the upper end of the plug member 25 attached to the mouth of the beverage container 31, in the straw storing portion 33*a*. In this case, the flanged portion 27 placed on the mouth of the beverage container 31 is sandwiched between the upper end of the mouth of the beverage container 31 and a marginal portion of the top plate 33 of the cap 32, and the cap 33 cannot be completely fitted to the mouth of the beverage container 31. However, the flanged portion 27 serves as a seal member so that the beverage in the beverage container 31 will not leak outside.

Thus, when the straw 21 is stored within the beverage container 31 to which the cap 32 is attached, the plug member 25 allows the straw member 22 to be retained so as not to tile or submerge in the beverage, and also allows the upper section of the straw member 22 to be protected so as not to be wetted with the beverage. In addition, the flanged portion 27 prevents the drink in the beverage container 31 from leaking outside.

Figure 6:
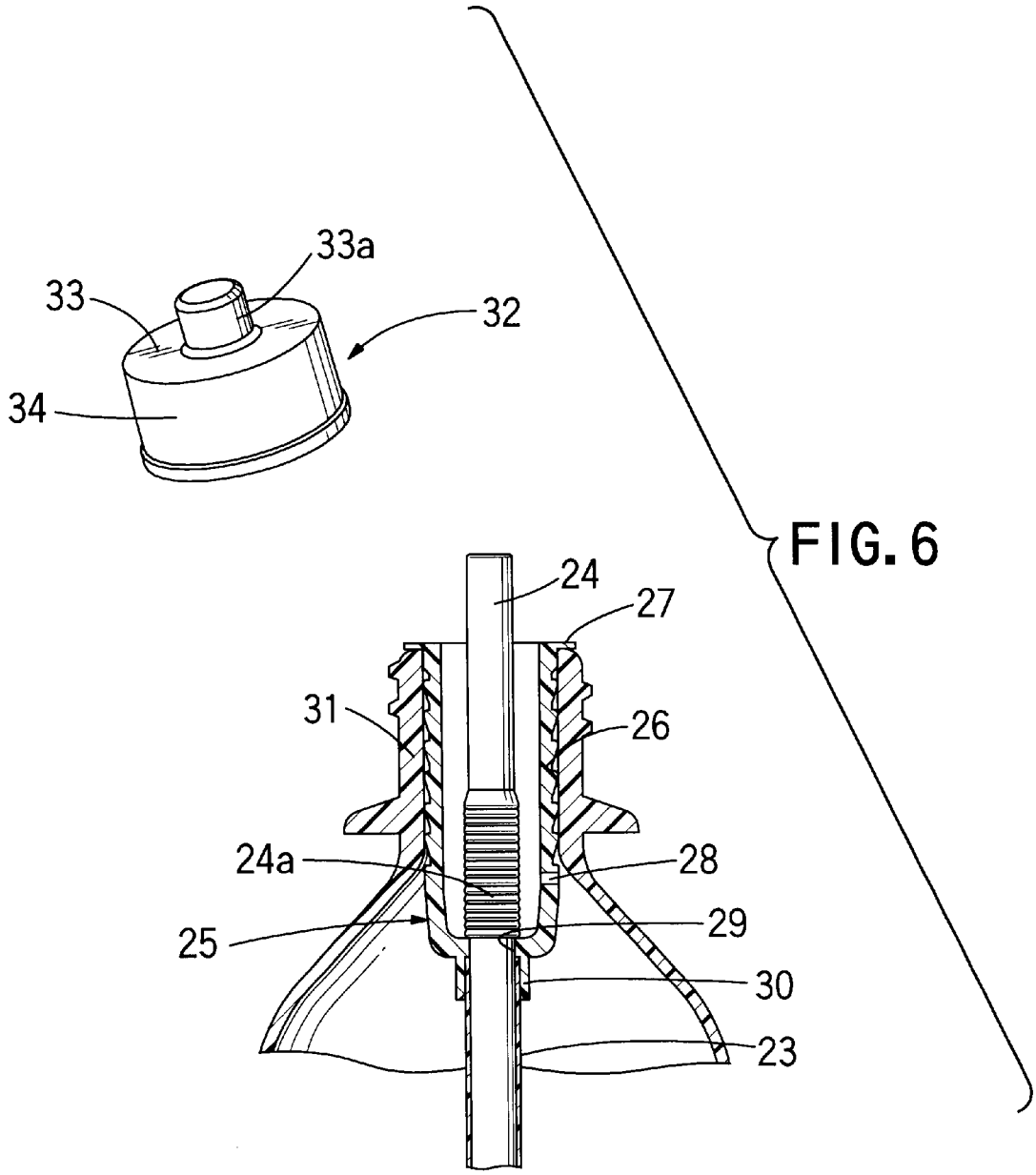
FIG. 6 shows the mouth portion of the beverage container shown in FIG. 5 where the cap at is detached.

FIG. 6 shows the mouth of the beverage container shown in FIG. 5 where the cap is removed. As shown in FIG. 6, when the cap 32 of the beverage container 31 is detached, the inner straw portion 24 protrudes from the upper end of the plug member 25. Thus, the inner straw portion 24 can be easily pulled out upward by picking up the protruded portion of the inner straw portion 24. As shown in FIG. 5, since the lower end of the straw member 22 extends to the vicinity of the beverage container 31, a user may exhaustively drink the beverage from the upper end of the inner straw portion 24 which has been pulled out. The accordion bending portion 24*a* provided in the inner straw portion 24 can be freely bent for drinking the beverage. Restricting the downward movement of the inner straw portion 24 as mentioned above can prevent the upper end of the inner straw portion 24 from being pushed downward and stored in the plug portion 26, and being not to protrude from the upper end of the plug member 25 when the cap is detached. Further, the air vent 28 is provided in the sidewall of the plug member 26. This may prevent the straw 21 from dropping off from the beverage container 31 due to increased inner pressure of the beverage container 31.

When the straw 21 is to be stored after drinking, the inner straw 24 is inserted downward to the lowest position, and the upper end of the inner straw portion 24 protruding from the upper end of the plug member 25 attached to the mouth of the beverage container 31 is stored in the straw storing portion 33a of the cap 32 as mentioned above. Then, the cap 32 is attached to the mouth of the beverage container 31 to store the straw 21 within the beverage container 31.

While the first and second embodiments according to the present invention have been described, the present invention is not limited to these and various modifications and variations can be made. For example, the outer straw portion and the plug member may be integrally formed instead of separate members.

In the state where the lower outer straw portion is fitted internally or externally to the outer straw inserting portion, the lower outer straw portion may be fixed to the outer straw inserting portion at the position where the upper end of the lower outer straw portion does not reach the plug portion, so that the outer straw inserting portion can serve as the upper outer straw portion which forms the outer straw portion integrally with the lower outer straw portion.

Further, the outer straw portion may include an accordion bending portion which is longitudinally retractable or extensible. This allows the length of the outer straw portion to be adjustable depending upon the length of the beverage container, so that the bottom end of the outer straw portion can reach the vicinity of the bottom wall of the beverage container. Otherwise, the lower outer straw portion may be telescopingly fitted with the outer straw inserting portion to make the outer straw inserting portion serve as the upper outer straw portion capable of adjusting its length and forming a retractable and extensible straw in the longitudinal direction integrally with the lower outer straw portion.

Instead of providing the outside diameter of the accordion portion larger than the straw through hole, the outside diameter of a suitable portion of the inner straw portion other than the accordion portion may be arranged larger than the straw through hole so as to restrict the downward movement of the inner straw portion. Otherwise, the downward movement of the inner straw portion may be restricted by making the inner straw portion reach the bottom wall of the beverage container.

In the first embodiment, the material of the upper straw portion is not limited to silicon elastomer, but it may be formed of materials having elasticity such as polyurethane elastomer, polyester elastomer, polyamide elastomer, polyolefin elastomer or others.

Further, in the first embodiment, the protruding length of the upper end of the inner straw portion having the upper straw portion at the lowest position of the inner straw portion having the upper straw portion is preferably in the range of about 10 to 15 mm from the mouth of the plug member. However, the above length may be arranged in any other dimensions if it allows the cap to be attached by pressing and bending the inner straw and allows the straw having the upper straw portion to be easily pulled out.

Furthermore, in the first embodiment, an air vent may be formed at the sidewall of the plug portion of the plug member as in the second embodiment.

As described above, according to the straw or the combination of straw and beverage container cap of the present invention, the beverage container cap can be attached to the beverage container with attaching the straw to the mouth of the beverage container. In addition, the straw member is retained so as not to tile or submerge in the beverage by the plug member, and the upper section of the straw member is protected so as not to be wetted with the beverage. This enables the straw to be contained and stored within the beverage container, sanitarily and readily, without the inability of taking out the straw from the beverage container or the contamination of hands or surroundings.

Since the upper end of the inner straw portion is protruded from the upper end of the plug member when the cap is detached, it is easy to pull out the inner straw portion.

Further, since the flanged portion of the plug member serves as a seal member, it is unlikely that the beverage in the beverage container leaks outside.

Further, the length from the upper end of the plug member to the lower end of the outer straw portion may be adjusted, so that the lower end of the outer straw portion may reach the vicinity of the bottom wall of the beverage container even if the length of the beverage container varies.

Furthermore, since the air vent is provided in the sidewall of the plug member, the straw may be prevented from dropping off from the beverage container due to increased inner pressure of the beverage container.

Further, the bendable or flexible accordion portion is formed at the inner straw portion so that the straw may be freely bent to easily drink the beverage.

What is claimed is:

1. A straw comprising:

a straw assembly and a plug, said straw assembly including an outer straw portion and an inner straw portion, said inner straw portion including a lower section made of a relatively hard plastic material and being slidably and telescopingly fitted to inside of said outer straw portion, said inner straw portion further including an upper section made of an elastomeric material and fitted to said lower section of said inner straw portion; and said plug being of a cylindrical configuration and having an open top, said outer straw portion having an upper end integral with or fitted to said plug, said upper section of said inner straw portion having a portion with a diameter capable of restricting said lower section from being inserted into said outer straw portion beyond a predetermined distance, said plug being adapted to be fitted to a mouth of a beverage container with said outer portion of said straw assembly inserted into said beverage. container, said upper section of said inner straw portion of said straw assembly having a portion projecting in a free state from said plug when said lower section of said inner straw portion is inserted into said outer straw portion to a position corresponding to said predetermined distance, said upper section of said inner straw portion being adapted to be flexed and contained in said plug when the plug is mounted on said mouth of the beverage container and a cap is attached.

2. A straw as defined in claim 1, wherein said upper section of said inner straw portion is formed of at least one component selected from the group consisting of silicon elastomer, polyurethane elastomer, polyester elastomer, polyamide elastomer, and polyolefin elastomer.

3. A straw as defined in claim 1, wherein said upper section of said inner straw portion is protruded in the range of about 10 to 15 mm from the mouth of said plug when said inner straw portion is located at the lowest position thereof.

4. A straw as defined in claim 1, wherein said plug includes a flanged portion protruding outward along an upper rim of said plug, wherein said plug is mounted to said mouth of said beverage container with placing said flanged portion on said upper end of said mouth of said beverage container.

5. A straw as defined in claim 1, wherein said lower section of said inner straw portion is longitudinally retractable.

6. A straw as defined in claim 5, wherein said outer straw portion comprises an upper outer straw portion and a lower outer straw portion, wherein said upper outer and lower straw portions are telescopingly fitted with each other, and the upper end of said upper outer straw portion is integrally formed with or fixed to said plug member.

7. A straw as defined in claim 5, wherein said outer straw portion comprises an accordion portion retractable in the longitudinal direction.

8. A straw as defined in claim 1, wherein said plug includes a vent hole at the sidewall or bottom section of said plug.

9. A straw as defined in claim 1, wherein said inner straw portion includes a bendable accordion bending portion.

10. A beverage container with straw, to which said straw as defined in claim 1 is mounted.

11. A combination of straw and beverage container cap, comprising:

a straw assembly and a plug, said straw assembly including a straw member having an outer straw portion and an inner straw portion including a lower section made of a relatively hard plastic material and being slidably and telescopingly fitted to inside of said outer straw portion, said inner straw portion further including an upper section made of an elastomeric material and fitted to said lower section of said inner straw portion and said plug being of a cylindrical configuration and having an open top, said outer straw portion having an upper end integral with or fitted to said plug, said upper section of said inner straw portion having a portion with a diameter capable of restricting said lower section from being inserted into said outer straw portion beyond a predetermined distance, said plug being adapted to be fitted to a mouth of a beverage container with said outer portion of said straw assembly inserted into said beverage container; and a beverage container cap including an upper section formed with a straw storing portion and a sidewall portion to be fitted to said mouth of said beverage container, wherein the upper section of said inner straw portion protruding from the upper end of said plug mounted to said mouth of said beverage container is stored within said straw storing portion so as to attach said beverage container cap to said beverage container.

12. A combination of straw and beverage container cap as defined in claim 11, wherein said plug includes a flanged portion protruding outward along an upper rim of said plug, wherein said plug is mounted to said mouth of said beverage container by placing said flanged portion on said upper end of said mouth of said beverage container.

13. A combination of straw and beverage container cap as defined in claim 11, wherein said lower section of said inner straw portion is longitudinally retractable.

14. A combination of straw and beverage container cap as defined in claim 13, wherein said outer straw portion comprises an upper outer straw portion and a lower outer straw portion, wherein said upper outer and lower straw portions are telescopingly fitted with each other, and the upper end of said upper outer straw portion is integrally formed with or fixed to said plug member.

15. A combination of straw and beverage container cap as defined in claim 13, wherein said outer straw portion comprises an accordion portion retractable in the longitudinal direction.

16. A combination of straw and beverage container cap as defined in claim 11, wherein said plug includes a vent hole at the sidewall or bottom section of said plug.

17. A combination of straw and beverage container cap as defined in claim 11, wherein said inner straw portion includes a bendable accordion bending portion.

18. A beverage container with straw, to which said combination of straw and beverage container cap as defined in claim 11 is mounted.

19. A straw used in said combination of straw and beverage container cap as defined in claim 11.

20. A beverage container cap used in said combination of straw and a beverage container cap as defined in claim 11.

* * * * *